US005266550A

United States Patent [19]

Asajima et al.

[11] Patent Number: 5,266,550

[45] Date of Patent: Nov. 30, 1993

[54] HEAT TRANSFER IMAGE-RECEIVING SHEET

[75] Inventors: Mikio Asajima; Takeshi Ueno; Katsuyuki Oshima, all of Tokyo, Japan

[73] Assignee: Dai Nippon Printing Co., Inc., Japan

[21] Appl. No.: 819,232

[22] Filed: Jan. 10, 1992

[30] Foreign Application Priority Data

Jan. 14, 1991 [JP] Japan ..... 3-15977

[51] Int. Cl.[5] ..... B41M 5/035; B41M 5/38

[52] U.S. Cl. ..... 503/229; 428/195; 428/206; 428/207; 428/212; 428/409; 428/690; 428/913; 428/914

[58] Field of Search ..... 8/471; 428/195, 409, 428/913, 914; 503/227

[56] References Cited

U.S. PATENT DOCUMENTS 5,023,129 6/1991 Morganti et al. ..... 428/195

FOREIGN PATENT DOCUMENTS 0407881 1/1991 European Pat. Off. ..... 503/227

OTHER PUBLICATIONS

Database Japio, No. 87-251191, Orbit Search Service Calif., US; & JP-A-62251191 (Unitika Ltd.) 10-3-1-1987.

*Primary Examiner*—B. Hamilton Hess
*Attorney, Agent, or Firm*—Parkhurst, Wendel & Rossi

[57] ABSTRACT

A heat transfer image-receiving sheet including a substrate sheet and dye-receiving layers formed on both sides of the substrate sheet, wherein both of the dye-receiving layers are matted.

4 Claims, No Drawings

HEAT TRANSFER IMAGE-RECEIVING SHEET

BACKGROUND OF THE INVENTION

The present invention relates generally to a heat transfer image-receiving sheet and, more particularly, to a heat transfer image-receiving sheet which enables high-quality images to be formed on both its sides.

Various heat transfer methods have been known so far in the art. Among them, there is proposed a method in which a heat transfer sheet prepared by carrying a sublimable dye, acting as a recording agent, on a substrate sheet such as a paper or a plastic sheet is used to form various full-color images on a heat transfer image-receiving sheet dyeable with the sublimable dye, for instance, that including a dye-receiving layer on the surface of paper or a plastic film.

According to this method, the thermal head of a printer is used as heating means to transfer a number of three- or four-color dots onto the heat transfer image-receiving sheet by a very quick heating stop, thereby reconstructing a full-color image of the original with the multi-color dots. The thus formed image is very clear because the coloring material used is a dye, and excels in the reproducibility and gradation of halftone because it excels in transparency. In addition, it is possible to obtain a high-quality image equivalent to that achieved by conventional offset or gravure printing and comparable to that attained by full-color photography.

Known as heat transfer image-receiving sheets usable with such a sublimation type of heat transfer technique as mentioned above are those made of such substrate sheets as plastic sheets, laminated sheets of plastic sheets with paper or the like, synthetic paper or plain paper, which have a dye-receiving layer or layers on one or both sides. Among them, an image-receiving sheet which enable images to be formed on both its sides by providing image-receiving layers on both sides of the substrate sheet is now expected to have wide applications in view of the effective exploitation of printing resources and a variety of image needs.

Some image-receiving sheets having image-receiving layers on both the sides have already been set forth in U.S. Pat. No. 4,778,782 and Japanese Patent Laid-Open (Kokai) Publication No. 64(1989)-47586.

However, the inventors have already found that the double-sided type of image-receiving sheet known so far in the art presents a problem inherent in images being formed on both its sides. For instance, when one image is formed on the first side of the sheet and another image is subsequently formed on the second side, not only is the image on the first side transferred onto the second side in the form of traces, but the image on the second side is left on the first side in the form of traces as well. As again found by the inventors, the cause of the "image traces" problem is unaccountable only by what is called the offset phenomenon or the transparency phenomenon ensuing from the thinness of the image-receiving sheet. Therefore, this "image traces" problem cannot drastically be solved, even though a substrate sheet having a hiding property well enough to prevent offset is used. Such image traces seriously degrade the commercial value of printed images.

SUMMARY OF THE INVENTION

In view of the above problem associated with the background art, a major object of this invention to provide a heat transfer image-receiving sheet which can provide a solution to the "image traces" problem inherent in images being formed on both sides of the heat transfer image-receiving sheet.

The above object is achievable by this invention which provides a heat transfer image-receiving sheet comprising a substrate sheet and dye-receiving layers formed on both sides thereof, fundamentally characterized in that both said dye-receiving layers are matted.

In order to eliminate the above image traces according to this invention, it is further important to control the gloss of the above dye-receiving layers to 40% or below.

According to this invention, more preferable effects are obtainable by placing a critical limitation on the relation between the thickness and gloss of the heat transfer sheet. In other words, it is preferred that the heat transfer image-receiving sheet of this invention concurrently satisfies the following conditions:

$$A<\alpha T, \quad \text{(I)}$$

and $$B<\beta T. \quad \text{(II)}$$

Here T is the thickness in $\mu$m of the heat transfer image-receiving sheet, A is the gloss in % of the first dye-receiving layer, and B is the gloss in % of the second dye-receiving layer. However, it is preferable that the values of $\alpha$ and $\beta$ are at most 0.3 (%/$\mu$m), preferably at most 0.2 (%/$\mu$m) and more preferably at most 0.1 (%/$\mu$m).

As already found by the inventors, the "image traces" problem caused by surface printing is unaccountable only by offset; it is a problem inherent in transfer with thermal printing means such as a thermal head. As a result of further studies, it has now been found that the image traces can be effectively eliminated by matting both the dye-receiving layers under the above conditions. That is, when an image is formed on one side of a heat transfer image-receiving sheet having dye-receiving layers on both sides of the substrate sheet, the other dye-receiving side is locally roughed up or matted by the pressure and energy applied thereon by a thermal head during heat transfer, so that image traces appear thereon. Further, when the substrate sheet is particularly thin, there is a problem that no high-quality image is obtained, because when images are formed on both its sides, the image on the back side may be seen through.

According to this invention, the dye-receiving layers which have been matted on their surfaces are provided on both sides of the substrate sheet, as mentioned above; even when an image is formed on one side, it is possible to effectively prevent the other side from being matted. Further, if white pigments, fillers or fluorescent whiteners are added to the dye-receiving layers and/or an intermediate layer, it is then possible to improve the clearness of the images formed on the dye-receiving layers and prevent image offset.

BEST MODE FOR CARRYING OUT THE INVENTION

This invention will now be explained at great length with reference to the preferred embodiments.

Although not critical, substrate sheets usable for this invention may be those made of synthetic paper (based on polyolefin and polystyrene), wood free paper, art or coated paper, cast-coated paper, wall paper-lining paper, synthetic resin- or emulsion-impregnated paper, synthetic rubber latex-impregnated paper, synthetic resin-incorporated paper, paper board, cellulose fiber paper, etc., or films or sheets of various plastics such as polyolefins, polyvinyl chloride, polyethylene terephthalate, polystyrene, polymethacrylate and polycarbonate. Also, white opaque or foamed films formed by adding white pigments or fillers to synthetic resins may be used as well.

Use may further be made of laminates comprising any desired combinations of the above substrate sheets. Typical laminates include those of cellulose fiber paper with synthetic paper or plastic films or sheets. The substrate sheet may have any desired thickness, but is generally of about 10 to 300 μm in thickness.

The above substrate sheet, when poor in the adhesion to the dye-receiving layers formed thereon, may preferably be treated on its surfaces with a primer or by corona discharge.

The above substrate sheet may be provided on its surfaces with intermediate layers for sealing to the dye-receiving layers or with a view to imparting adhesion and cushioning and hiding properties to the dye-receiving layers. For instance, they may be formed of adhesive and cushioning resins such as vinyl resin, polyurethane resin and rubber resin at a thickness of 0.5 to 40 μm. These intermediate layers may additionally contain additives such as white pigments, e.g., titanium oxide; fillers, e.g., calcium carbonate, clay and talc; and fluorescent whiteners.

The dye-receiving layers formed on the surfaces of the above substrate sheet or intermediate layers serve to receive the sublimable dye coming from the heat transfer sheet and maintain the formed images thereon. The binder resins for forming the dye-receiving layers, for instance, may be polyolefinic resin such as polypropylene; halogenated vinylic resin such as polyvinyl chloride and polyvinylidene chloride, vinylic resin such as polyvinyl acetate and polyacrylic ester, polyester resin such as polyethylene terephthalate and polybutylene terephthalate, polystyrene resin, polyamide resin, copolymeric resin such as copolymers of olefins such as ethylene and propylene with other vinyl monomers, ionomers, cellulose resin such as cellulose diacetate and polycarbonate. Among them, particular preference is given to the vinyl and polyester resins.

The dye-receiving layers may be formed on the heat transfer image-receiving sheet by coating a solution or dispersion of the above binder resin in a suitable organic solvent or water, which also contains the required additives, e.g., releasants, antioxidants and UV absorbers, on both sides of the substrate sheet by suitable means such as gravure printing, screen printing or reverse roll coating using a gravure plate, followed by drying.

The above dye-receiving layers should preferably contain a releasant so as to impart good releasability to the heat transfer sheet. Preferable to this end are silicone oil, phosphate surfactants and fluorine surfactants, but preference is given to the silicone oil, which may preferably be denatured or modified with epoxy, alkyl, amino, carboxy, alcohol, fluorine, alkylalkyl polyether, epoxy/polyether, polyether, etc. The releasants may be used alone or in combination, and should preferably be added to 100 parts by weight of the binder resin in an amount of 1 to 20 parts by weight. When the releasant(s) is added in an amount departing from the above range, some problems may arise, such as a fusion of the heat transfer sheet and dye-receiving layer or a drop of printing sensitivity. The thus formed dye-receiving layers should preferably lie in the range of 1 to 50 g/m$^2$ on dry coverage basis. When the dry coverage is below the lower limit, the resultant dye-receiving layers become too thin to form satisfactory images.

As with the intermediate layers, these dye-receiving layers may additionally contain additives such as white pigments, e.g., titanium oxide, fillers, e.g., calcium carbonate, clay and talc and fluorescent whiteners.

Matting the thus formed dye-receiving layers and regulating their glosses may preferably be achieved by the following procedures:

(1) Coating

In order to form a matted dye-receiving layer immediately, an ink for forming the dye-receiving layer, which contains a filler having a suitable particle size, such as microsilica or calcium carbonate, may be coated on each side of the substrate sheet. The gloss of the dye-receiving layer may then be adjusted by varying the amount of the above filler having a particle size of about 0.1–10 μm within the range of 20–60% by weight, for instance.

(2) Embossing

The dye-receiving layer formed on each side of the substrate sheet may be treated with an embossing roll. The gloss of the dye-receiving layer may then be adjusted by varying the surface roughness of the embossing roll. A sheet material which has been matted by some means may be used instead of treating the dye-receiving layer with the embossing roll.

(3) Sandblasting

A large amount of fine particles may be blown onto the dye-receiving layer provided on each side of the substrate sheet for matting. The gloss of the dye-receiving layer may then be adjusted by varying the quantity of the particles blown.

(4) Treatment with Sandpaper

The dye-receiving layer provided on each side of the substrate sheet may be rubbed with sandpaper. The gloss of the dye-receiving layer may then be adjusted by varying the surface roughness of the sandpaper used or the number of rubbing.

(5) Treatment with Matting PET

Inks for forming the dye-receiving and intermediate layers may be coated on matting PET to form these layers. Then, the substrate sheet is laminated on the matting PET, followed by releasing the matting PET. The gloss of the dye-receiving layer may then be adjusted by controlling the surface roughness of the matting PET used.

In the above matting treatment, the gloss of the dye-receiving layer is of particular importance. In this case, it is desired that the resultant gloss be regulated to at most 40%, preferably at most 20%. At a gloss higher than 40%, a local matting of the back side occurring during image formation will be accentuated, and printability and other properties will become insufficient as well. The "gloss" as used herein may be measured according to JIS P-8142-65, and the measurement thus found will be used as a standard in the present disclosure.

According to this invention, better effects are attainable by controlling the relation between the gloss and thickness of the dye-receiving layer within a specific range.

More specifically, it is desired in this invention that the following conditions as met at the same time:

$$A<\alpha T, \quad \text{(I)}$$

and $$B<\beta T, \quad \text{(II)}$$

where T is the thickness in μm of the heat transfer image-receiving sheet, A is the gloss in % of the first dye receiving layer, and B is the gloss in % of the second dye-receiving layer. However, it is preferable that the values of $\alpha$ and $\beta$ are at most 0.3 (%/μm), preferably at most 0.2 (%/μm) and more preferably at most 0.1 (%/μm).

Furthermore, it is preferred in this invention that for the purpose of improving the feeding of the image-receiving sheet through a printer, a slipping agent may be added into the composition for the dye-receiving layer.

The heat transfer sheet used for heat transfer with the heat transfer image-receiving sheet of this invention may be formed of a paper or polyester film with a sublimable dye-containing layer provided on it. In other words, all heat transfer sheets known so far in the art may be used as such for the invention.

As means for applying heat energy for heat transfer, use may be made of any desired means known so far in the art. For instance, the desired object is well achievable by the application of a heat energy of about 5–100 mJ/mm$^2$ with recording hardware such as a thermal printer (e.g., Video Printer made by Hitachi, Ltd.) for a controlled time.

The present invention will now be explained more specifically but not exclusively with reference to the following examples and comparative examples. Bear in mind that unless otherwise stated, the "parts" and "%" will be given by weight.

EXAMPLE 1

Coating solutions for the intermediate and dye-receiving layers, whose compositions will be given below, were coated on both sides of a substrate sheet of synthetic paper (Yupo-FRG-150 made by Oji Yuka K.K. and having a thickness of 150 μm) by means of a bar coater at the respective dry coverage of 1.0 g/m$^2$ and 4.0 g/m$^2$, pre-dried in a dryer and then dried at 100° C. for 30 minutes in an oven to form dye-receiving layers, which were in turn matted on their surfaces by embossing, sandblasting or treatment with sandpaper to obtain a heat transfer image-receiving sheet according to this invention.

| | |
|---|---|
| Coating Solution for Intermediate Layer | |
| Polyurethane Resin Emulsion | 100 parts |
| Water | 30 parts |
| Coating Solution For Dye-Receiving Layers | |
| Vinyl Chloride/Vinyl Acetate Copolymer (#1000D made by Denki Kagaku Kogyo K.K.) | 100 parts |
| Amino-Modified Silicone (X-22-343 made by The Shin-Etsu Chemical Co., Ltd.) | 3 parts |
| Epoxy-Modified Silicon (KF-343 made by The Shin-Etsu Chemical Co., Ltd.) | 3 parts |
| Methyl Ethyl Ketone/Toluene (at 1:1 weight ratio) | 500 parts |

EXAMPLES 2–3

The procedures of Example 1 were followed with the exception that the glosses of the dye-receiving layers were regulated to 20% and 10%, respectively, whereby heat transfer image-receiving sheets according to this invention were obtained.

EXAMPLES 4–7

The procedures of Example 1 were followed with the exception that the coating solutions for the intermediate and dye-receiving layers contained such additives as set out in Table 1, whereby heat transfer image-receiving sheets according to this invention were obtained.

TABLE 1

| | |
|---|---|
| Ex. 4 | 20 parts of titanium oxide were added to the coating solution for the dye receiving layers |
| Ex. 5 | 20 parts of titanium oxide were added to the coating solution for the intermediate layers |
| Ex. 6 | 1 part of a fluorescent whitener was added to the coating solution for the dye-receiving layers |
| Ex. 7 | 1 part of a fluorescent whitener was added to the coating solution for the intermediate layers |

COMPARATIVE EXAMPLES 1–3

The procedures of Example 1 were followed with the exception that the glosses of the dye-receiving layers were 90%, 70% and 50%, respectively, whereby comparative heat transfer image-receiving sheets were obtained.

On the other hand, an ink for the dye layer, whose composition will be given below, was coated on a 6-μm thick polyethylene terephthalate film, which had been subjected on the back side to a heat-resistant treatment, at a dry coverage of 1.0 g/m$^2$ by means of a wire bar, followed by drying. Further, some drops of silicone oil (X-41.4003A made by Shin-Etsu Silicone K.K.) were added to the back side of the film through a dropper and spread all over it for back coating to obtain a heat transfer film.

| Ink Composition for the Dye Layer | |
|---|---|
| Disperse Dye (Kayaset Blue 714 made by Nippon Kayaku K.K.) | 4.0 parts |
| Ethylhydroxycellulose (Hercules Co., Ltd.) | 5.0 parts |
| Methyl Ethyl Ketone/Toluene (at 1:1 weight ratio) | 80.0 parts |
| Dioxane | 10.0 parts |

While the above heat transfer films were superimposed on the dye-receiving layers of each of the above image-receiving sheets, printing was carried out using a thermal head at an output of 1 W/dot, a pulse width of 0.3–0.45 msec. and a dot density of 3 dots/mm to form cyan images, and the whitenesses of the dye-receiving layers and how much their back sides were locally matted were examined. The results are set out in Table 2.

TABLE 2

| Ex. Nos. | Whitenesses of the Dye-Receiving Layers | Image Traces |
|---|---|---|
| Ex. | | |
| 1 | Pale Yellow | 1 |
| 2 | Pale Yellow | 1 |
| 3 | Pale Yellow | 1 |
| 4 | Good | 1 |
| 5 | Good | 1 |
| 6 | Good | 1 |
| 7 | Good | 1 |

TABLE 2-continued

| Ex. Nos. | Whitenesses of the Dye-Receiving Layers | Image Traces |
|---|---|---|
| Comp. Ex. | | |
| 1 | Pale Yellow | 5 |
| 2 | Pale Yellow | 4 |
| 3 | Pale Yellow | 3 |

In Table 2, the "image traces" were estimated in terms of to what degree the image on the first side appeared as traces on the second side, say, in the order of 1–5.

According to this invention, even when an image is formed on one side of the substrate sheet, it is unlikely that undulations occurring on the opposite side are noticeable, because the matted dye-receiving layers have been applied to both sides of the substrate sheet.

Further, the incorporation of the white pigment, filler or fluorescent whitener into the dye-receiving and/or intermediate layers enables the images formed on the dye-receiving layers to be much improved in terms of sharpness, and serves well to prevent the image on the back side from being seen through.

EXAMPLES 8–10

In each of these examples, coating solutions for the intermediate and dye-receiving layers, whose compositions will be given below, were coated on both sides of a substrate sheet of coated paper (Mirror Coat made by Kanzaki Seishi K.K. and having a thickness of 100 μm) by means of a bar coater at the respective dry coverages of 1.0 g/m$^2$ and 4.0 g/m$^2$, pre-dried in a dryer and then dried at 100° C. for 30 minutes in an oven to form dye-receiving layers, which were in turn matted on their surfaces by embossing, sandblasting or treatment with sandpaper to obtain a heat transfer image-receiving sheet according to this invention.

| | |
|---|---|
| Coating Solution for Intermediate Layer | |
| Polyurethane Resin Emulsion | 100 parts |
| Water | 30 parts |
| Coating Solution For Dye-Receiving Layers | |
| Vinyl Chloride/Vinyl Acetate Copolymer (#1000D made by Denki Kagaku Kogyo K.K.) | 100 parts |
| Amino-Modified Silicone (X-22-343 made by The Shin-Etsu Chemical Co., Ltd.) | 3 parts |
| Epoxy-Modified Silicon (KF-343 made by The Shin-Etsu Chemical Co., Ltd.) | 3 parts |
| Methyl Ethyl Ketone/Toluene (at 1:1 weight ratio) | 500 parts |

EXAMPLE 11

The procedures of Example 10 were followed with the exception that the synthetic paper (Yupo-FRG made by Oji Yuka K.K. and having a thickness of 100 μm) was used as the substrate sheet and the glosses of the dye-receiving layers were regulated to 15%, whereby a heat transfer image-receiving sheet according to this invention was obtained.

EXAMPLE 12

The procedures of Example 10 were followed with the exception that synthetic paper (Mirror Coat made by Kanzaki Seishi K.K. and having a thickness of 200 μm) was used as the substrate sheet and the glosses of the dye-receiving layers were regulated to 35%, whereby a heat transfer image-receiving sheet according to this invention was obtained.

COMPARATIVE EXAMPLE 4

The procedures of Example 10 were followed with the exception that the coated paper (Mirror Coat made by Kanzaki Seishi K.K. and having a thickness of 100 μm) was used as the substrate sheet and the glosses of the dye-receiving layers were regulated to 42%, whereby a heat transfer image-receiving sheet according to this invention was obtained.

COMPARATIVE EXAMPLE 5

The procedures of Example 10 were followed with the exception that the coated paper (Mirror Coat made by Kanzaki Seishi K.K. and having a thickness of 200 μm) was used as the substrate sheet and the glosses of the dye-receiving layers were regulated to 65%, whereby a heat transfer image-receiving sheet according to this invention was obtained.

The glosses, thicknesses and image traces of the thus obtained heat transfer image-receiving sheets are set out in Table 3.

TABLE 3

| Ex. | Glosses | Thicknesses | Image Traces |
|---|---|---|---|
| Ex. | | | |
| 8 | 25% | 100 μm | 2 |
| 9 | 15% | 100 μm | 1 |
| 10 | 5% | 100 μm | 1 |
| 11 | 15% | 100 μm | 2 |
| 12 | 35% | 200 μm | 2 |
| Comp. Ex. | | | |
| 4 | 42% | 100 μm | 4 |
| 5 | 65% | 200 μm | 4 |

What is claimed is:

1. A heat transfer image-receiving sheet to be used in combination with a heat transfer sheet having a sublimable dye layer formed on a substrate, said heat transfer image-receiving sheet comprising:

a substrate sheet having a first surface and an opposed second surface;

a first dye-receiving layer formed on said first surface of said substrate sheet; and a second dye-receiving layer formed on said second surface of said substrate sheet;

wherein both of said first and second dye-receiving layers (i) comprises a dyeable resin for receiving a sublimable dye from the sublimable dye layer of the heat transfer sheet, (ii) are matted, and (iii) have a gloss of at most 40%.

2. A heat transfer image-receiving sheet as claimed in claim 1, wherein the following conditions (I) and (II) are met at the same time:

$$A<0.3T, \quad \text{(I)},$$

and $$B<0.3T, \quad \text{(II)}$$

where T is the thickness in μm of the heat transfer image-receiving sheet, A is the gloss in % of the first dye-receiving layer, and B is the gloss in % of the second dye-receiving layer.

3. A heat transfer image-receiving sheet as claimed in claim 1, wherein the following conditions (I) and (II) are met at the same time:

$$A<0.2T, \quad \text{(I)}$$

and $$B<0.2T, \quad \text{(II)}$$

where T is the thickness in μm of the heat transfer image-receiving sheet, A is the gloss in % of the first dye-receiving layer, and B is the gloss in % of the second dye-receiving layer.

4. A heat transfer image-receiving sheet as claimed in claim 1, further comprising an intermediate layer between each of said dye-receiving layers and said substrate sheet, wherein at least one of said dye-receiving layers and said intermediate layers contains at least one of a white pigment, a filler and a fluorescent whitener.

* * * * *

UNITED STATES PATENT AND TRADEMARK OFFICE

CERTIFICATE OF CORRECTION

PATENT NO. : 5,266,550

DATED : November 30, 1993

INVENTOR(S) : Mikio ASAJIMA, Takeshi UENO and Katsuyuki OSHIMA

It is certified that error appears in the above-identified patent and that said Letters Patent is hereby corrected as shown below:

On the title page, Item [73]: change "Inc." to --Ltd.--.

Signed and Sealed this

Tenth Day of May, 1994

*Attest:*

Bruce Lehman

BRUCE LEHMAN

*Attesting Officer*

*Commissioner of Patents and Trademarks*